US007322910B2

(12) United States Patent
Denoth et al.

(10) Patent No.: US 7,322,910 B2
(45) Date of Patent: Jan. 29, 2008

(54) TRAINING DEVICE

(76) Inventors: Viktor Denoth, Funkwiesenstrasse 68, CH-8050 Zürich (CH); Sandra Bonacina, Funkwiesenstrasse 68, CH-8050, Zürich (CH)

( * ) Notice: Subject to any disclaimer, the term of this patent is extended or adjusted under 35 U.S.C. 154(b) by 0 days.

(21) Appl. No.: 10/541,922

(22) PCT Filed: Jan. 15, 2004

(86) PCT No.: PCT/CH2004/000019

§ 371 (c)(1),
(2), (4) Date: Sep. 19, 2005

(87) PCT Pub. No.: WO2004/064942

PCT Pub. Date: Aug. 5, 2004

(65) Prior Publication Data

US 2006/0105894 A1 May 18, 2006

(30) Foreign Application Priority Data

Jan. 22, 2003 (EP) ..... 03001409

(51) Int. Cl.
*A63B 26/00* (2006.01)

(52) U.S. Cl. ..... 482/142; 482/148

(58) Field of Classification Search ..... 482/140, 482/91, 907, 23, 148, 142
See application file for complete search history.

(56) References Cited

U.S. PATENT DOCUMENTS 2,950,120 A * 8/1960 Stewart ..... 482/51
3,857,563 A * 12/1974 Azara ..... 482/142
3,968,604 A * 7/1976 Hills ..... 52/86
4,752,067 A * 6/1988 Colonello ..... 482/140
4,927,139 A * 5/1990 Taltre ..... 482/142
4,980,936 A * 1/1991 Frickland et al. ..... 5/420
D328,324 S * 7/1992 Wang ..... D21/809
5,207,704 A * 5/1993 Shields ..... 606/240
5,394,577 A * 3/1995 James et al. ..... 5/713
5,444,881 A * 8/1995 Landi et al. ..... 5/708
5,584,786 A * 12/1996 Almeda ..... 482/142
6,289,910 B1 * 9/2001 Zheng ..... 135/125

FOREIGN PATENT DOCUMENTS

DE 202 00 585 1/2002
DE 202 03 975 3/2002

* cited by examiner

*Primary Examiner*—Lori Amerson
(74) *Attorney, Agent, or Firm*—Notaro & Michalos PC

(57) ABSTRACT

A training device is disclosed, or a device for training, sport, gymnastics and for therapy, characterized by an arched planar element (1), having a largely rectangular outline. The arching or curvature encloses an angle of at least 30°, said angle generally being an angle of ca. 30-180°, preferably ca. 60-100°. The arched planar element can have a nearly form stable embodiment, made from wood, a polymeric material, such as a reinforced polymer or light metal. It is also possible to give the element a weakly elastic embodiment, using a correspondingly weakly elastic material such as wood, or a correspondingly weakly elastic polymer.

11 Claims, 1 Drawing Sheet

Figur 1:
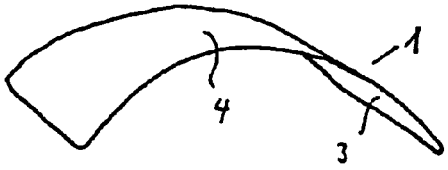
Figur 2:
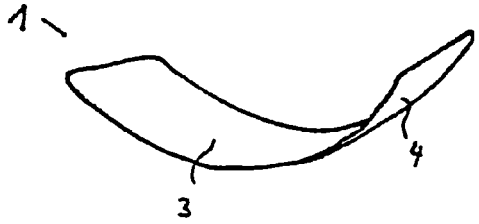
Figur 3:
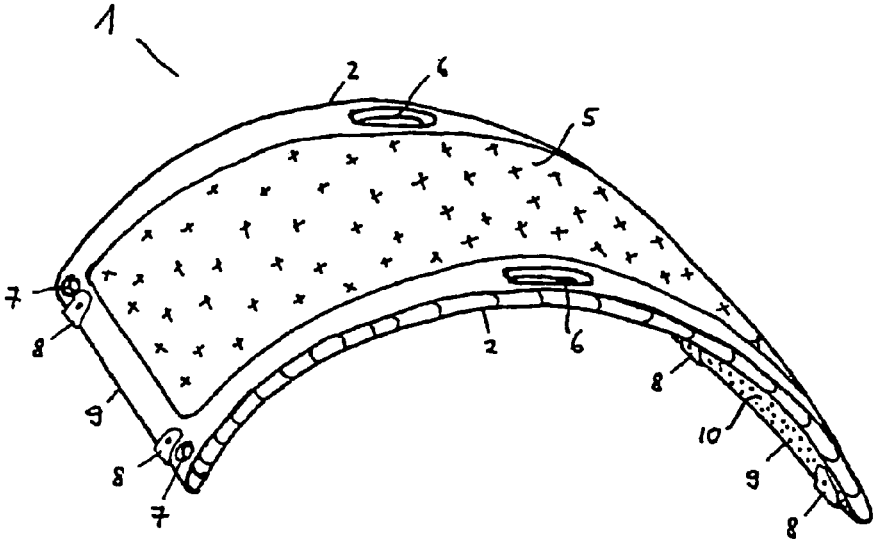

TRAINING DEVICE

FIELD AND BACKGROUND OF THE INVENTION

The present invention relates to a training device or an apparatus for exercising, sports and gymnastics and therapy, as well as a method for the production of a training device.

For physical training, in particular for home use, but also in fitness centers, many complicated, complex and heavy devices exist, which, moreover, as a rule, are also rather expensive. Conventional strength and endurance devices, also those for private use, are often cumbersome to handle and also require much space, i.e. they cannot be readily removed and be stored for example in a chamber or side room. In addition, the known devices can only be utilized primarily in a single area and for a single purpose and are therefore one-sided. For this reason, many different devices are required to cover all areas which are to be exercised.

A number of less complicated devices are known from prior art. For example the German Utility Patent DE 200 17 464 proposes a multifunction training apparatus, the Utility Patent G 90 06 479.8 and U.S. Pat. No. 5,584,786 disclose semi-cylindrical training devices, as well as U.S. Pat. Nos. 3,967,820, 4,902,003 and 5,795,276 bench-like training devices, which, while they are simpler of construction compared to conventional training devices, however, all of these can only be applied relatively specifically for a certain exercise purpose. The same applies also to the device described in U.S. Pat. No. 5,496,248.

SUMMARY OF THE INVENTION

The aim of the present invention comprises proposing a training apparatus, with which the body can to a large extent be exercised overall. According to the invention an apparatus is accordingly proposed following the wording of claim 1. Proposed is an apparatus for training, or a training device, which comprises an arched sheet element with a substantially rectangular outline, the curvature or arch enclosing an angle of at least approximately 30°. The training device proposed according to the invention is comprised of a rectangular plate, which is preferably at least nearly uniformly curved, and which plate, or which sheet element, has approximately the same thickness or wall thickness over the entire area. According to a preferred embodiment variant, the arch or curve encloses an angle of approximately 30-180°, preferably approximately 60-100°.

Again according to a further embodiment variant, the length of the element along a bent edge is approximately 60-120 cm, preferably approximately 70-90 cm and the width is in a range of approximately 40-80 cm, preferably approximately 45-60 cm and the thickness of the element or of the plate is in the range of approximately 1.5-4 cm, preferably approximately 1.5-2.5 cm.

Due to its physical form, the training device is bilaterally usable and preferably dimensionally stable, comprised of wood, a polymeric material, such as a reinforced polymer, or it is comprised of a light metal, such as for example aluminum. However, it is also possible to implement the device such that it is slightly elastic by utilizing a correspondingly elastic wood or a slightly elastic polymer.

According to a preferred embodiment variant of the training device according to the invention, the angle enclosed by the arch is approximately 90°, the length along the bent edge is approximately 80 cm, the width approximately 50 cm and preferably a thickness of approximately 2 cm is chosen. It is understood that the arching can also be greater or less, it can be circular, oval or elliptical. The specified dimensions can also be greater or less, depending on the requirements and the target users, whether these be children, adolescents or adults. The surface of the convex side can be provided with a damping coating, such as of an elastomeric material, such as rubber, latex, elastomer polymer, foamed material, etc. The concave side is preferably provided with a non-slip coating. It is furthermore possible to provide on the training device according to the invention grip handles, holes and the like, for example for fastening additional materials.

The production of the training device according to the invention is simple by starting, for example, with a rectangular plate, which is bent to form a quarter circle. It is understood that it is also possible, especially when using polymeric materials, to inject the material into a mold having already a curvature.

The training device proposed according to the invention is astonishingly simple, light-weight, multiply applicable, multifunctional, easy to carry, easy to store, not expensive, simply stackable in extremely small space, in particular when using several devices, such as for example when the devices are employed in exercise centers, fitness centers or in school gymnasiums.

All conditioning factors of physical fitness in the area of strength, endurance, mobility and coordination (balance) can be covered, and, in terms of exercise, this can take place at a low or a high level, prophylactically or also within the framework of rehabilitation. The device can be utilized everywhere, in the home, at the work place, in fitness studios, in health and wellness centers, in physiotherapy or in medical offices, in gymnasiums or other leisure and sports facilities. The device can be employed as an individual station or also for group exercises or as a station in circuit training. Due to its curved form, both sides can be used—the convex side can serve as a stepper for endurance training or as a support for the harmonic strengthening of the body; through its rocking movement the concave side promotes inter alia especially balance or coordination of the entire body. It can also be utilized as a support in mental training.

In conclusion the training device according to the invention will be explained by example in further detail and with reference to the attached drawing, in which depict:

BRIEF DESCRIPTIONS OF THE DRAWINGS

FIGS. 1 and 2 in schematic simplification one training device each according to the invention in the two positions of use, and FIG. 3 an embodiment variant of a training device according to the invention.

DESCRIPTION OF THE PREFERRED EMBODIMENTS

FIG. 1 and 2 show schematically that the training device according to the invention is largely a shell in the form of a quarter circle, which either, as shown in FIG. 1, can be disposed such that it is fixedly positioned, or such that it is suitable for balancing exercises in a nonstable position, as depicted in FIG. 2. It is understood that the shell does not need to have the form of a quarter circle, but rather can also be of different segments of a circle, can be implemented elliptically or can have any other desired curvature.

FIG. 3 lastly shows an embodiment variant of a training device 1 according to the invention in perspective view in the fixed position, e.g. with the convex side 4 directed upwardly. The training device 1 again involves a shell of approximately quarter-circle form, which is provided with a damping coating 5 in the central region on its upper convex side 4. This coating can comprise an elastic material, such as rubber, latex, a foamed substance or another elastic polymer. On the underside, or the concave side, 3 the shell is preferably implemented such that it is slip resistant, i.e. it is provided with a non-slip coating. However, this resistance to slipping can be attained thereby that the surface of the shell is slightly roughened.

The two end edges 9 of the quarter-circle-shaped shell are also preferably implemented such that they are slip resistant or are provided with a non-slip edge protection 8, which, in the manner of clips, can be placed over the end edge 9 or can be, for example, firmly connected with the end edge 9 by adhesion.

Along each of the longitudinal edges or bent edges 2 one grip handle 6 each is provided, for example in order to facilitate the transport of the training device 1. Lastly, at one end of the training device openings 7 are provided, for example for attaching additional materials, such as for example rubber pulls suitable for additional exercise capabilities.

As is clearly evident in FIG. 1 to 3, the training device proposed according to the invention is of extremely simple structure and accordingly is readily producible. The remaining advantages do not need to be discussed further, since these have already been sufficiently recognized above.

It is understood that the training devices depicted in FIG. 1 to 3 are only examples, which can be changed or modified in any desired manner or can be supplemented by further elements. In particular the proportions can be varied, the bending angle, the curvature itself, whether circular, oval, etc., as well as also the materials employed for the production of the training device can be varied or changed. It is understood that it is also possible to provide additional elements, such as perforations, grip handles and the like.

The invention claimed is:

1. Apparatus for training the human body, comprising:

an arched sheet element having a substantially rectangular outline, the arch or curve of the sheet element enclosing an angle of at least approximately 30°, the surface of a convex side of the sheet element being provided with a damping layer comprised of an elastomeric material or natural damping substance, or a polymer, and further including a concave side of the sheet element being slip-resistant.

2. Apparatus as claimed in claim 1, characterized in that the arch or curve is at least nearly uniform, and the element has approximately the same thickness or wall thickness all over.

3. Apparatus as claimed in claim 1, characterized in that the arch or curve encloses an angle of approximately 30-180°.

4. Apparatus for training the human body, comprising:

an arched sheet element having a substantially rectangular outline, the arch or curve of the sheet element enclosing an angle of at least approximately 30°, the surface of a convex side of the sheet element being provided with a damping layer comprised of an elastomeric material or natural damping substance, or a polymer, and further including a concave side of the sheet element being slip-resistant, characterized in that the length of the element along the bent edge is approximately 60-120 cm, and that the width is approximately 40-80 cm, and the thickness of the element is approximately 1.5-4 cm.

5. Apparatus as claimed in claim 1, characterized in that the element is at least nearly dimensionally stable, and is fabricated of wood, a polymeric material, or of a light metal, and the edges are rounded on all sides.

6. Apparatus for training the human body, comprising:

an arched sheet element having a substantially rectangular outline, the arch or curve of the sheet element enclosing an angle of at least approximately 30°, the surface of a convex side of the sheet element being provided with a damping aver comprised of an elastomeric material or natural damping substance, or a polymer, and further including a concave side of the sheet element being slip-resistant, characterized in that the element is slightly elastic and is fabricated of a correspondingly slightly elastic wood or a correspondingly slightly elastic polymer, and all edges on all sides are rounded.

7. Apparatus as claimed in claim 1, characterized in that the angle enclosed by the arch or curve is approximately 90°, the length of the bent edge is approximately 80 cm, the width approximately 50 cm and the thickness of the element is approximately 2 cm.

8. Apparatus as claimed in claim 1, characterized in that the arch or curve is circular, oval or elliptical.

9. Apparatus as claimed in claim 1, characterized in that on the element grip handles, or holes are provided.

10. Method for the production of an apparatus as claimed in claim 1, characterized in that a substantially rectangular plate of wood, a polymeric material or of a light metal, is bent into the appropriate form.

11. Apparatus as claimed in claim 1, wherein the sheet element includes terminal support edges each with a non-slip edge protection.

* * * * *